US006900423B2

(12) United States Patent
Chun

(10) Patent No.: US 6,900,423 B2
(45) Date of Patent: May 31, 2005

(54) MICROWAVE OVEN AND CONTROL UNIT THEREOF

(75) Inventor: Yun-Bong Chun, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/458,322

(22) Filed: Jun. 11, 2003

(65) Prior Publication Data

US 2004/0134900 A1 Jul. 15, 2004

(30) Foreign Application Priority Data

Jan. 11, 2003 (KR) ..... 10-2003-0001840

(51) Int. Cl.[7] ..... H05B 6/66
(52) U.S. Cl. ..... 219/702; 219/716
(58) Field of Search ..... 219/702, 716, 219/720, 714, 761, 506, 72, 492, 622; 714/42; 711/137, 218; 718/100, 107; 68/12.27; 341/33

(56) References Cited

U.S. PATENT DOCUMENTS 4,266,118 A * 5/1981 Takase et al. ..... 219/492
4,290,052 A * 9/1981 Eichelberger et al. ..... 341/33
4,446,350 A * 5/1984 Mizukawa et al. ..... 219/622
5,894,549 A * 4/1999 Cheng ..... 714/42
6,304,891 B1 * 10/2001 Anderson et al. ..... 718/107
6,626,013 B2 * 9/2003 Ohta et al. ..... 68/12.27

OTHER PUBLICATIONS

Korean Patent Abstract No.: 2002–34582, dated May 9, 2002.

Korean Patent Abstract No.: 2002–6984, dated Jul. 14, 2000.

* cited by examiner

*Primary Examiner*—Quang T. Van
(74) *Attorney, Agent, or Firm*—Staas & Halsey LLP

(57) ABSTRACT

A microwave oven includes a widely applicable and extensible Reduced Instruction Set Computer (RISC) microprocessor, allowing a control panel to be easily included, and which controls various functions using a single microprocessor, reducing a size of the control panel. The microwave oven also includes a control panel in which soft touch switches using electrostatic capacity are substituted for membrane switches, allowing the control panel to be formed in various forms including a curved form.

7 Claims, 4 Drawing Sheets

MICROWAVE OVEN AND CONTROL UNIT THEREOF

CROSS-REFERENCE TO RELATED APPLICATION

This application claims the benefit of Korean Application No. 2003-1840, filed Jan. 11, 2003, in the Korean Intellectual Property Office, the disclosure of which is incorporated herein by reference.

BACKGROUND OF THE INVENTION

1. Field of the Invention

The present invention relates, in general, to a microwave oven, and more particularly, to a microwave oven and control unit thereof.

2. Description of the Related Art

A microwave oven emits microwaves of 2450 MHz generated by a magnetron onto food and heats the food. When microwaves vibrate molecules of the food, heat is generated due to collisions between the molecules, so that the food is cooked by the heat.

FIG. 1 is a block diagram showing a construction of a conventional microwave oven. As shown in FIG. 1, a control unit 102 controls an overall operation of the microwave oven. An input unit 104 and an external memory 106 are connected at input terminals of the control unit 102. The input unit 104 is provided with cooking mode setting buttons and numeral buttons to set cooking modes, cooking time, etc. The external memory 106 stores cooking data of each of the cooking modes. The control unit 102 has a magnetron drive unit 108, a fan drive unit 112, a tray motor drive unit 116 and a display drive unit 120 connected to output terminals of the control unit 102. The magnetron drive unit 108 drives a magnetron 110 to generate microwaves. The fan drive unit 112 drives a cooling fan 114 to cool various kinds of electrical devices installed in a machine room of the microwave oven. The tray motor drive unit 116 drives a tray motor 118 to rotate a tray (not shown) disposed in a cooking room. The display drive unit 120 drives a display unit 122 to display a help menu and cooking information of the cooking modes, and to set specific values.

In the conventional microwave oven, a control panel installed in the input unit 104 is a membrane switch control panel which is based on a control panel using mechanical switches. Recently, the control panel has been implemented as a touch screen control panel using a Liquid Crystal Display (LCD).

When the control panel is implemented as the membrane switch control panel, it allows various visual designs compared to the control panel using mechanical switches. Thus, an appearance of the membrane switch control panel may be designed to be attractive.

Additionally, life of the control panel using mechanical switches is not long due to a mechanical abrasion of the mechanical switches. In contrast, the membrane switch control panel is semi-permanent because a circuit and contact points are formed on two or more films, and electrical contact between the contact points is used. Further, films forming membrane switches are very thin, so that the membrane switch control panel may be manufactured to be thinner than the control panel using the mechanical switches.

However, the membrane switch control panel may not overcome the limits of low practical uses of the conventional control panel using the mechanical switches. One function is allocated to each of the mechanical and membrane switches. Thus, a number of switches corresponding to respective functions may not be proportional to an increase in the functions to be implemented in the microwave oven. Since an area of the control panel of the microwave oven is limited, a number of installable switches is limited in the control panel using mechanical switches and the membrane switch control panel.

The touch screen control panel using the LCD provides unlimited input or setting functions on a control panel having a limited area. If a user touches switches or buttons displayed on a screen of the LCD, a signal allocated to a corresponding switch or button is transmitted to the control unit 102. That is, a main menu or main functions are allowed to be displayed and selected on an initial screen of the LCD. Sub-menu or sub-functions corresponding to the main menu or main functions, respectively, are displayed on another screen and arranged to be hierarchical based on necessity, so that almost unlimited menus or functions are able to be implemented using the touch screen control panel.

Even if the hierarchical construction of the menus using the LCD is almost unlimited, it needs to be limited so that the user is not inconvenienced when cooking food in the microwave oven. That is, if the microwave oven is constructed so that an advanced function may not be used until a user reaches a sub-menu to select a specific sub-function through several steps, the user may experience extreme inconvenience in using the function such that the user may ignore the function.

Accordingly, it is preferable that another switch or button to perform basic functions of the microwave oven, such as power ON/OFF, cooking start and temporary stop, is provided without displaying the functions using the LCD. Further, the membrane switch control panel may be manufactured in only a flat form due to its structural characteristics. Accordingly, it is difficult to develop various designs to correspond to demands of the user using the membrane switch control panel.

The conventional microwave oven generally uses a Complex Instruction Set Computer (CISC) microprocessor. For this reason, a microprocessor has to be additionally installed to add a new function to the microwave oven, requiring a new control panel to be designed and increasing cost of the microwave oven.

SUMMARY OF THE INVENTION

Accordingly, it is an aspect of the present invention to provide a microwave oven, which employs an widely applicable and extensible Reduced Instruction Set Computer (RISC) microprocessor, allowing a new control panel to be easily developed, and which controls various functions using a single microprocessor, reducing a size of a control panel.

Another aspect of the present invention is to provide a control panel, in which soft touch switches using electrostatic capacity are substituted for membrane switches, allowing a control panel to be provided in various forms including a curved form.

Additional aspects and advantages of the invention will be set forth in part in the description which follows and, in part, will be obvious from the description, or may be learned by practice of the invention.

The foregoing and/or other aspects of the present invention are achieved by providing a microwave oven including a control unit provided with a RISC microprocessor and designed to control an overall operation of the microwave oven. The control unit includes a soft touch panel in which electrostatic capacity varies depending upon touched positions, and a soft touch panel drive circuit to detect the variation of the electrostatic capacity of the soft touch panel, to generate an electrical signal in response to the variation of the electrostatic capacity and to provide the electrical signal to the microprocessor.

BRIEF DESCRIPTION OF THE DRAWINGS

The above and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
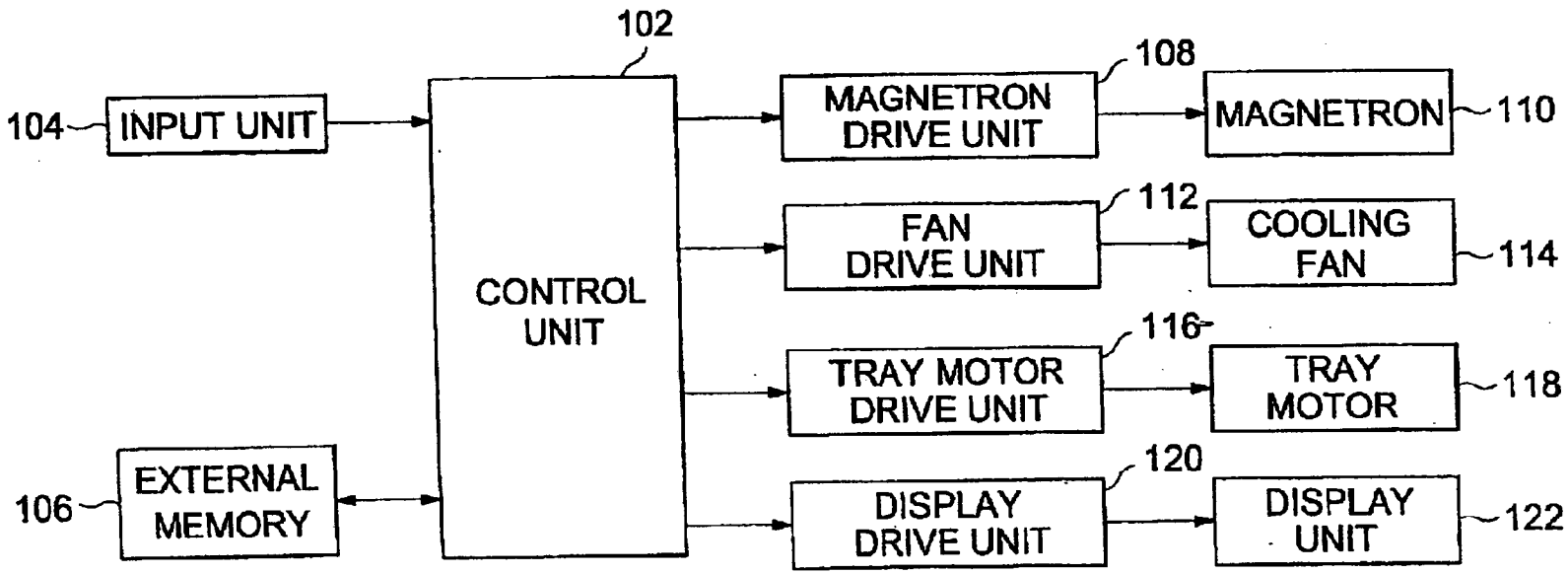
FIG. 1 (PRIOR ART)
FIG. 1 is a block diagram showing the construction of a conventional microwave oven.

Reference will now be made in detail to the present preferred embodiments of the present invention, examples of which are illustrated in the accompanying drawings, wherein like reference numerals refer to like elements throughout.

Figure 2:
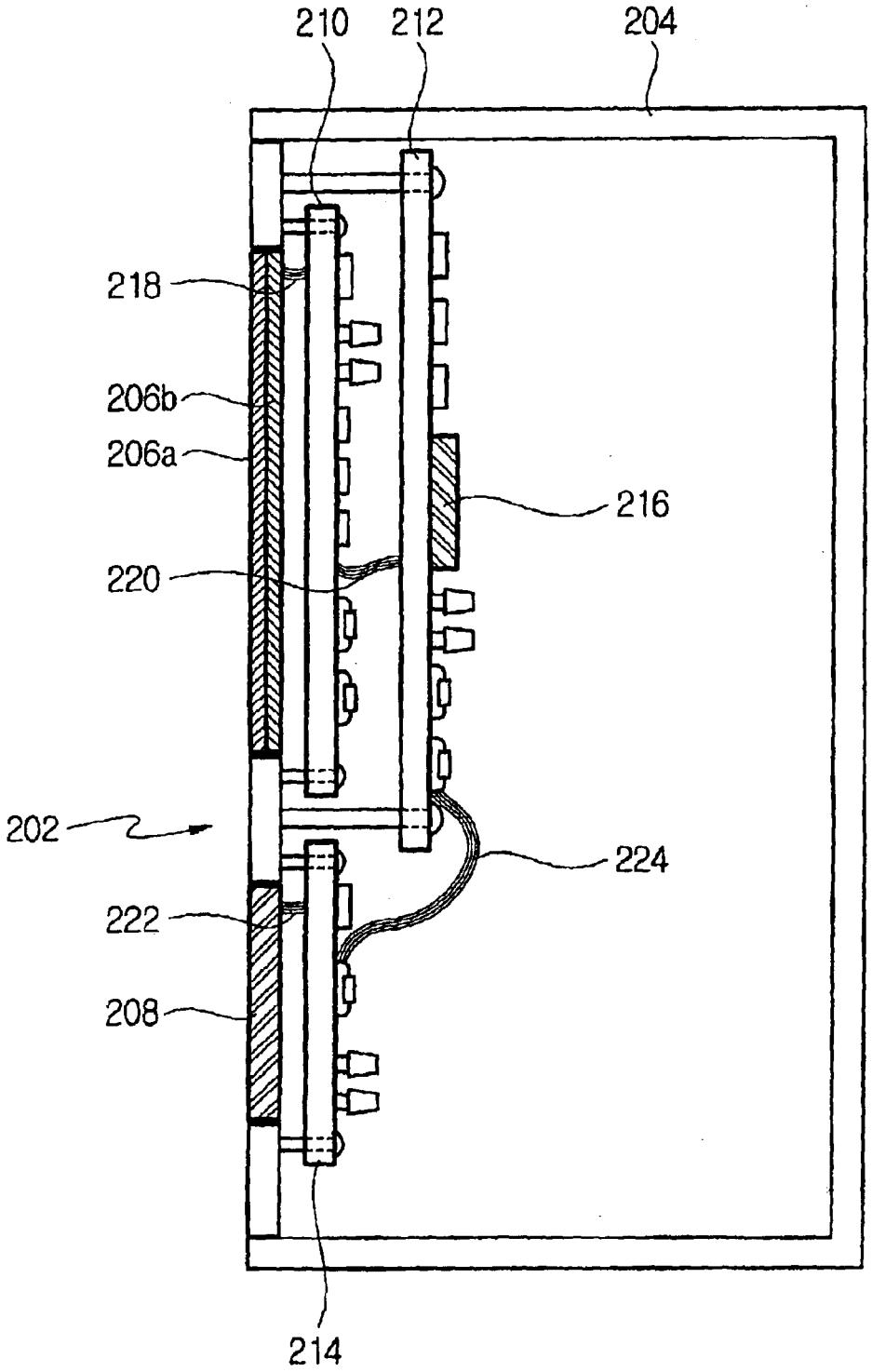
FIG. 2 is a sectional view of a control panel, according to an embodiment of the present invention.

Various embodiments of a microwave oven and control unit thereof of the present invention are described with reference to FIGS. 2 through 4. FIG. 2 is a sectional view of a control panel 202, according to an embodiment of the present invention. As shown in FIG. 2, a control panel 202 is disposed in front of a casing 204. An LCD 206*b* provided with a touch screen 208 and a soft touch panel 206*a* are included in the control panel 202. Different from membrane and mechanical switches, the soft touch panel 206*a* designates an input device to obtain results corresponding to those obtained by pressing a switch or button through a touching action of a user but with no necessity for a user to press a switch, such as a membrane or mechanical switch, or a button. In the soft touch panel 206*a*, a variation of electrostatic capacity is generated at the time a user touches the soft touch panel 206*a*. A soft touch panel drive circuit detects the variation of the electrostatic capacity and generates an electrical signal in response to the variation of the electrostatic capacity. A microprocessor receives the electrical signal generated from the soft touch panel drive circuit and performs a control operation previously set to correspond to the variation of the electrostatic capacity.

An LCD drive circuit board 210 and a main circuit board 212 are installed inside the casing 204 in layers behind the LCD 206*b*. The LCD drive circuit board 110 communicates with the main circuit board 212 via a communication cable 220. An electrical circuit is formed on the LCD drive circuit board 210 to drive the LCD 206*b*. The LCD 206*b* and the LCD drive circuit board 210 are connected to communicate with each other through a communication cable 218, so that data signals relating to a control of the soft touch panel 206*a* and the LCD 206*b* are exchanged therebetween. An electrical circuit required to control the overall operation of the microwave oven is provided on the main circuit board 212. Since a microprocessor 216 mounted on the main circuit board 212 has a RISC construction, software expansion to implement an additional function of the microwave oven is easily done, and the additional development of hardware is not needed.

An LCD of the microwave oven is generally displayed in monochrome or under a four-level gray scale. However, it is difficult to implement multimedia functions using a conventional CISC microprocessor. In the embodiment of the present invention, a RISC microprocessor that carries out excellent digital signal processing functions is included.

The RISC microprocessor 216 carries out a real-time digital signal processing algorithm such as a voice recognition function, a reproduction function of a compressed audio file (MP3), or an image data processing function, without the use of another digital signal processor. Accordingly, a voice recognition function and a function of a multimedia system may be easily expanded without developing new hardware. That is, the RISC microprocessor 216 may implement a complicated hardware construction in a software manner, so that new hardware is not needed to be developed and new functions are added by upgrading the software of the microprocessor 216 when new functions are added to the microwave oven. Thus, the control panel 202 may be miniaturized regardless of the addition of the functions of the microwave oven.

A soft touch drive circuit board 214 on which an electrical soft touch panel drive circuit that drives the soft touch panel 208 is formed, is provided behind the soft touch panel 208 in the casing 204. The soft touch panel drive circuit provided on the soft touch drive circuit board 214 detects the variation of the electrostatic capacity generated at the time the user touches the soft touch panel 208, and generates an electrical signal in response to the variation of the electrostatic capacity. A construction of the soft touch panel drive circuit provided on the soft touch drive circuit board 214 is described with reference to FIG. 3.

Figure 3:
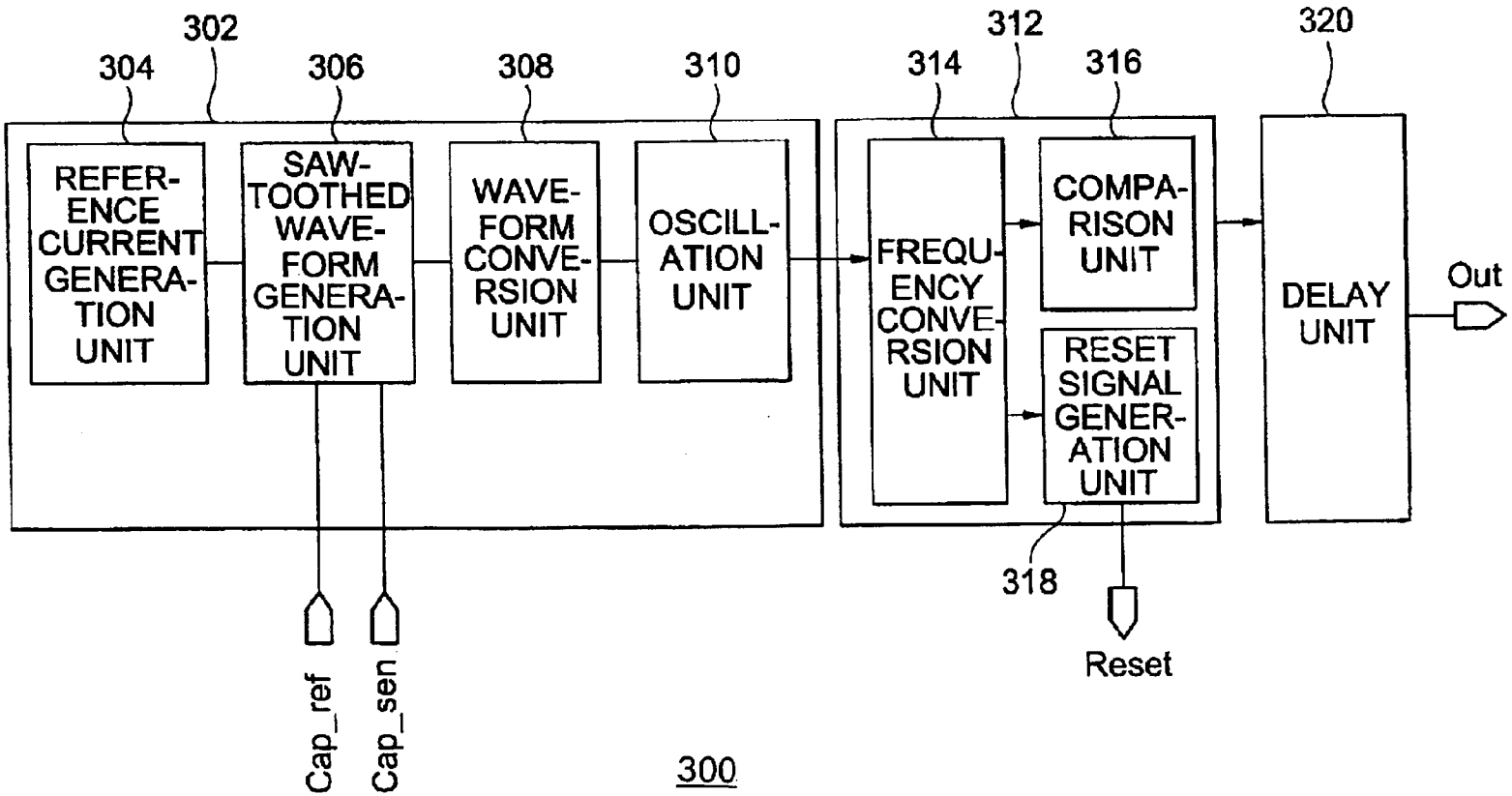
FIG. 3 is a block diagram showing an example of the construction of a soft touch panel drive circuit to detect a variation of an electrostatic capacity of a soft touch panel.

FIG. 3 is a block diagram showing an example of the construction of the soft touch panel drive circuit 300 to detect the variation of the electrostatic capacity of the soft touch panel, according to an embodiment of the present invention. As shown in FIG. 3, in the soft touch panel drive circuit 300 of the microwave oven according to the present invention, an electrostatic capacity detection unit 302 detects the variation of the electrostatic capacity generated at the time the user touches the soft touch panel 208, and outputs an electrical sense signal in response to the variation of the electrostatic capacity and a reference signal in a rectangular waveform. A determination unit 312 compares the rectangular-shaped electrical sense signal with the rectangular-shaped reference signal which are output from the electrostatic capacity detection unit 302 and thereby, determines whether the user has touched an input terminal of the soft touch panel 208. A delay unit 320 outputs an output signal after delaying the output signal of the determination unit 312 for a certain period of time to allow a stable operation of the soft touch panel drive circuit.

The electrostatic capacity detection unit 302 includes a reference current generation unit 304 to supply constant current to the soft touch panel drive circuit, a saw-toothed waveform generation unit 306 to generate saw-toothed Alternating Current (AC) signals based on a reference signal Cap_ref and an electrical sense signal Cap_sen applied through the input terminal of the soft touch panel 208, and a waveform conversion unit 308 to convert the saw-toothed AC signals into rectangular-shaped signals. The electrostatic capacity detection unit 302 also includes an oscillation unit 310 provided at an output terminal of the waveform conversion unit 308, to generate an AC electrical energy. The oscillation unit 310 allows stable rectangular-shaped signals to be generated by feeding back its output signals to the saw-toothed waveform generation unit 306. The reference current generation unit 304 uses a current mirror sense amplifier to generate constant current.

The saw-toothed waveform generation unit 306 generally uses the charge and discharge of a capacitor to generate the saw-toothed AC signal of the reference signal Cap_ref and the saw-toothed AC signal having a frequency proportional to a value of the electrostatic capacity of the electrical sense signal Cap_sen. The waveform conversion unit 308 converts the saw-toothed AC signals output from the saw-toothed waveform generation unit 306 into rectangular-shaped signals. If a voltage of each of the saw-toothed AC signals is equal to or greater than a reference voltage, the waveform conversion unit 308 outputs a high-state signal. If the voltage of each of the saw-toothed AC signals is less than the reference voltage, the waveform conversion unit 308 outputs a low-state signal. The waveform conversion unit 308 may implement this function by using a Schmitt trigger circuit.

The oscillation unit 310 includes a ring oscillator to apply an input of the last inverter of a plurality of inverters connected in series to each other, to an input of the first inverter of the plurality of inverters. In this way, the oscillation unit 310 feedbacks the outputs of odd inverters to the saw-toothed waveform generation unit 306 and oscillates its output signals.

The determination unit 312 includes a frequency conversion unit 314 to convert the output signals of the oscillation unit 310 into low frequency signals, and a comparison unit 316 to determine whether the user has touched the input terminal by comparing the rectangular-shaped electrical sense signal and the rectangular-shaped reference signal which are frequency-converted by the frequency conversion unit 314. The determination unit 312 also includes a reset signal generation unit 318 that generates a reset signal Reset using the output signals of the frequency conversion unit 314 to enhance a sensitivity of the comparison of the electrical sense signal with the reference signal.

The frequency conversion unit 314 includes a plurality of flip-flops to increase the sensitivity by lowering the frequencies of the rectangular-shaped electrical sense signal and the rectangular-shaped reference signal which are output from the oscillation unit 310. The comparison unit 316 compares the low frequency of the rectangular-shaped electrical sense signal with the low frequency of the rectangular-shaped reference signal, and then outputs an output signal which indicates that the user has touched the input terminal if the compared frequencies are different. The delay unit 320 delays the output signal Out output from the comparison unit 316 for a certain period of time so that the output signal Out is generated at the time the user touches the input terminal to prevent a malfunction of the soft touch panel drive circuit.

Menu items or functions to be selected by the user are displayed on the soft touch panel 208, and electrostatic capacity sensors (not shown) are installed behind the soft touch panel 208 to correspond to positions where the menu items or the functions are disposed. The installed electrostatic capacity sensors are electrically connected to the soft touch drive circuit board 214 through a communication cable 222. In this case, the sensors are constructed so that variation of the electrostatic capacity generated at the time the user touches the input terminal is different according to the positions where the menu items or the functions are displayed. The soft touch drive circuit board 214 is electrically connected to the main circuit board 212 through a communication cable 224 to communicate with the main circuit board 212. If the user selects a menu item or a function displayed on the soft touch panel 208, the sensors disposed in the corresponding positions sense the variation of the electrostatic capacity resulting from a touching action by the user.

The variation of the electrostatic capacity detected by the electrostatic capacity sensor is converted into an electrical signal through the soft touch panel drive circuit shown in FIG. 3, and the electrical signal is transmitted to the main circuit board 212. The RISC microprocessor 216 of the main circuit board 212 recognizes the menu item or the function selected by the user using the variation of the electrostatic capacity supplied from the soft touch panel drive circuit 300, and performs a control operation to implement the corresponding menu item or the corresponding function.

If the above-described soft touch panel drive circuit 300 is used, the soft touch panel 208 may be implemented in a manner, different from that of a mechanical or membrane switch control panel, but similar to that of a touch screen control panel. Additionally, the soft touch panel 208 may be manufactured in various forms such as a curved form, as well as a flat form to which the membrane switch control panel is restricted. Thus, the soft touch panel 208 according to the present invention may be designed to have a more attractive appearance than the membrane switch control panel.

Figure 4:
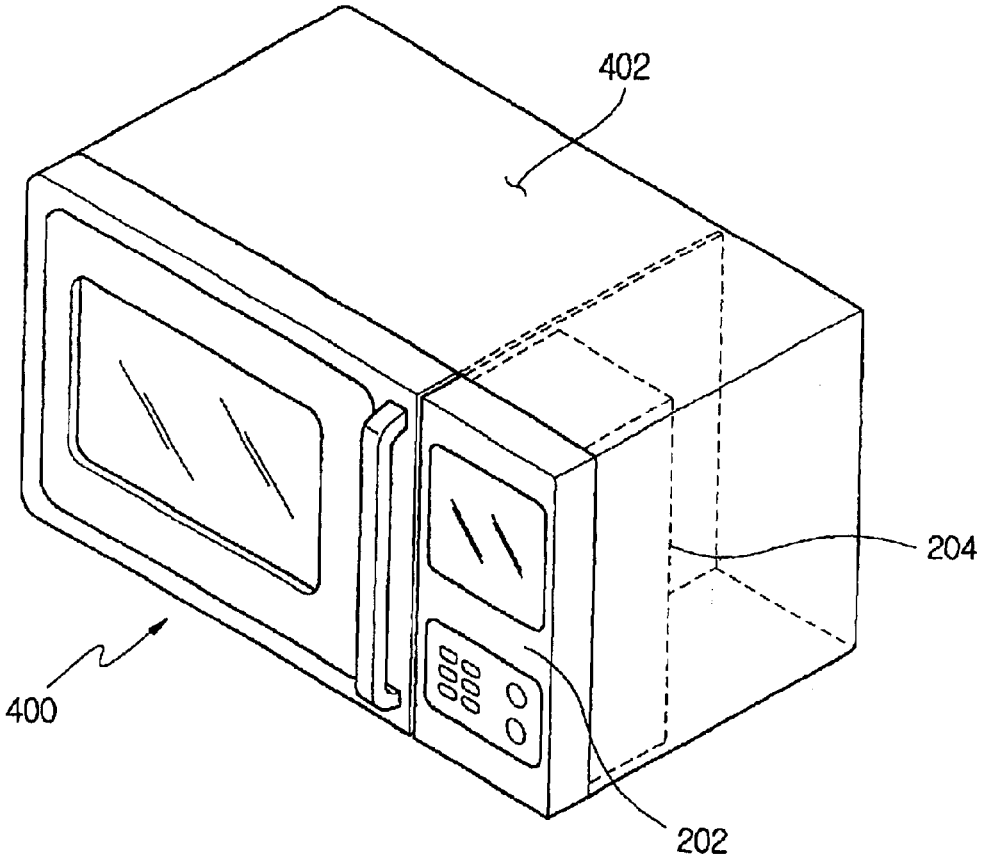
FIG. 4 is a view of a control panel and a casing installed in front of a machine room of a microwave oven.

FIG. 4 is a view of the control panel 202 and the casing 204 installed in front of a machine room of the microwave oven 400. As shown in FIG. 4, the control panel 202 is installed in the front of the machine room and positioned in the front of an overall body 402 of the microwave oven 400. The control panel 202 is attached to the casing 204 positioned behind the control panel 202, so that the control panel 202 is insulated from a magnetron or a high voltage circuit unit installed in the machine room.

As is apparent from the above description, the present invention provides a microwave oven which employs a widely applicable and extensible RISC microprocessor, allowing a control panel to be easily developed, and which controls various functions using a single microprocessor, reducing the size of the control panel. Additionally, the present invention provides a control panel of a microwave oven, in which a soft touch panel using electrostatic capacity is substituted for switches, allowing the control panel to be formed in various forms.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A control unit of a microwave oven, comprising:

a Reduced Instruction Set Computer (RISC) microprocessor that carries out a digital signal processing function including a voice recognition function, a reproduction function of a compressed audio file, and an image compressing function;

a soft touch panel in which electrostatic capacity varies depending upon touched positions; and a soft touch panel drive circuit to detect the variation of the electrostatic capacity of the soft touch panel to generate an electrical signal in response to the variation of the electrostatic capacity and to provide the electrical signal to the microprocessor; wherein the soft touch panel drive circuit comprising:

an electrostatic capacity detection unit to detect the variation of the electrostatic capacity which is generated when the soft touch panel is touched, and to output an electrical sense signal in response to the variation of the electrostatic capacity and a reference signal in a rectangular waveform.

2. The control unit as set forth in claim 1, wherein the microwave oven comprises a color liquid crystal display, and an image reproduced by the microprocessor is controlled to be displayed on the color liquid crystal display.

3. The control unit as set forth in claim 1, further comprising:

a determination unit to determine if the soft touch panel has been touch based on a comparison between a rectangular-shaped electrical sense signal and a rectangular-shaped reference signal output from the electrostatic capacity detection unit, and to output a signal based on the determination; and a delay unit to output a signal after delaying an output signal provided by the determination unit for a predetermined time, allowing for a stable operation of the soft touch panel drive circuit and preventing a malfunctioning of the soft touch panel drive circuit.

4. The control unit as set forth in claim 1, wherein the electrostatic capacity detection unit comprises:

a reference current generation unit to supply constant current to the soft touch panel drive circuit;

a saw-toothed waveform generation unit to generate saw-toothed Alternating Current (AC) signals based on the reference signal and the electrical sense signal applied through an input terminal of the soft touch panel;

a waveform conversion unit to convert the saw-toothed AC signals into the rectangular-shaped signals; and an oscillation unit provided at an output terminal of the waveform conversion unit, to generate an AC electrical energy.

5. The control unit as set forth in claim 4, wherein the oscillation unit stabilizes the rectangular-shaped signals by feeding back output signals thereof to the saw-toothed waveform generation unit.

6. The control unit as set forth in claim 5, wherein the determination unit comprises:

a frequency conversion unit to convert the output signals of the oscillation unit into low frequency signals;

a comparison unit to receive output signals from the frequency conversion unit and to determine if the soft touch panel has been touched by comparing the rectangular-shaped electrical sense signal and the rectangular-shaped reference signal which are frequency-converted by the frequency conversion unit; and a reset signal generation unit to generate a reset signal using the output signals of the frequency conversion unit to enhance a sensitivity of the comparison of the rectangular-shaped electrical sense signal and the rectangular-shaped reference signal.

7. The control unit as set forth in claim 1, wherein the soft touch panel is provided in a curved form.

* * * * *